United States Patent [19]

Cooper

[11] 4,453,155

[45] Jun. 5, 1984

[54] FIRE PROTECTION FOR WOOD SHINGLE ROOF

[75] Inventors: Gary D. Cooper, Arlington, Tex.

[73] Assignee: Raincloud, Inc., Fort Worth, Tex.

[76] Inventor: Gary D. Cooper, 3720 Danbury Dr., Arlington, Tex. 76016

[21] Appl. No.: 334,076

[22] Filed: Dec. 23, 1981

Related U.S. Application Data

[63] Continuation-in-part of Ser. No. 172,664, Jul. 28, 1980, which is a continuation-in-part of Ser. No. 132,867, Mar. 24, 1980, abandoned.

[51] Int. Cl.[3] ..... G08B 25/00

[52] U.S. Cl. ..... 340/289

[58] Field of Search ..... 340/289; 169/16, 13, 169/2

[56] References Cited

U.S. PATENT DOCUMENTS 3,583,490 6/1971 McFadden ..... 169/16

*Primary Examiner*—Harold I. Pitts

*Attorney, Agent or Firm*—Peter J. Murphy

[57] ABSTRACT

The water dispensing system includes sprinkler heads mounted on risers extending through the roof surface and supplied by PVC pipe suspended beneath the roof surface. Alternatively, porous hose may be mounted along the ridges. Water is supplied through an electrically motorized valve and electric motor driven booster pumps. The control circuit includes one or more flame sensor circuits each consisting of an electric current conductor disposed in selectively spaced runs and connected to the coil of a signal relay. Smoke detector sensor circuits include relay switches and operating coils, which coils are activated in response to a selected smoke level. The relay switches are connected by the control circuit to energize the motorized valve and the pump motor. The water flow is initiated either when flame overtakes a run of a flame sensor conductor or when a smoke detector detects the selected smoke level.

24 Claims, 9 Drawings Figures

FIRE PROTECTION FOR WOOD SHINGLE ROOF

This application is a continuation-in-part of application Ser. No. 172,664, filed July 28, 1980; which application is, in turn, a continuation-in-part of application Ser. No. 132,867, filed Mar. 24, 1980 now abandoned.

BACKGROUND AND SUMMARY OF THE INVENTION

This invention relates in general to a system and method for minimizing damage to a building due to a fire originating in the roof of the building, the system having other advantages, and more particularly to a system and method for arresting a fire which may have started on the exterior roof surface, such as by a flying ember for example, before that fire produces significant damage.

While the invention has application in roofs fabricated from any flammable material, the invention is particularly useful in connection with wood shingle roofs.

Wood shingle roofs are hazardous in the event of a fire, because they are extremely flammable when dry, causing a rapid spread of a fire throughout a structure. For structures having a large expanse of wood shingle roof, the damage can be very great unless some means is provided to retard the spread of the fire along the roof. Wood shingle roofs represent a particular hazard where a number of neighboring homes have such roofs, particularly when such homes are erected in close proximity. In that situation, a fire in one structure may quickly spread to neighboring structures, through flying sparks or embers, particularly under high wind conditions. In these situations, a major fire fighting effort may be directed to saving adjacent structures, rather than minimizing damage at a primary fire which is already well advanced.

It has been observed that a fire starting at the exposed surface of a wood shingle roof, by an ember for example, will spread in a predetermined manner; and this invention is concerned with an automatic system for detecting such a fire at a very early stage and in extinguishing that fire before it can spread to any significant degree.

There are known in the prior art systems for dispensing water onto the exterior roof of a building, residence or otherwise, for the purpose of wetting down the roof to perhaps prevent a roof fire from being ignited by flying embers or sparks in the event of a nearby brush fire, forest fire or structure fire, for example. Such systems are disclosed in Thompson U.S. Pat. No. 1,620,142, Banzato U.S. Pat. No. 3,179,181, and McFadden U.S. Pat. No. 3,583,490. The latter two of these patents disclose systems for supplying the water from a source such as a swimming pool to dispensing means on the roof, including electric motor driven pumps which may be put into operation automatically in response to a detection system. The detection devices for these systems are thermostats which are responsive to the heat of flame and it is thought that these may be placed on or about the structure in any desired manner. A difficulty with thermostats, particularly if there are a relatively few thermostats spaced over a relatively large roof area, is that they will likely not be responsive to a fire until it has been well established, except in the situation of course where the fire may start at the precise location of one thermostat. The placing of a sufficiently large number of thermostats to detect a small fire before it has spread significantly presents problems of substantial expense with respect to both the cost of the thermostats themselves and to the costs for wiring up a substantial number of thermostats. Another difficulty with such systems is that if a fire destroys the wiring before detection is accomplished, the system is rendered inoperative. Another difficulty with such system, particularly where relatively few thermostats are used, is that the fire may not be detected until it is well established and the established fire may rupture the water supply system before it has been effective to wet the roof surface. A major problem in connection with roof protection systems then is to provide a sensing device or system which is effective to detect a small fire at any location on the roof surface and before it has spread significantly, and to activate the water dispensing system to extinguish the fire before it has advanced to the extent that it may render inoperative either the detection system or the water dispensing system. The above mentioned prior art patents do not suggest a practical solution to that problem.

A further problem with the provision of a practical detection system for detecting fires on the exterior roof surface is that the detection devices or systems should most advantageously be placed on that exterior roof surface. This means that the detection devices or systems must have the capability of withstanding various deteriorating conditions and incidents, and still maintain reliability. Foremost among these conditions are the elements: sun, wind, rain, sleet, ice and snow. A condition with wood shingle roofs that results from the elements is that the shingles buckle and crack with time. The system must be resistant to materials which may be deposited on roofs such as leaves, nuts falling from trees, and other blowing plant material and debris which drops from trees or other vegetation. Further the detection devices or systems must be resistant to the activities of animals which move about roofs and also to humans who have occasion to be on roofs for various service and maintenance purposes.

One object of this invention is to provide a system and method for preventing or retarding the spread of fires which originate at the exposed surface of a roof.

A further object of this invention is to provide a system and method for extinguishing very quickly a wood roof fire which has been started by an ember or a spark from a neighboring fire.

Still another object of this invention is to provide a system and method for detecting a fire in a building roof, and for effecting automatically an extinguishing water flow.

A still further object of this invention is to provide a system and method for effectively detecting a small roof surface fire at any location on a wood shingle roof.

Another object of this invention is to provide a system for detecting very quickly a small fire in a wood shingle roof and for automatically initiating extinguishing water flow before the fire can spread significantly.

A further object of this invention is to provide a system for reducing the cost of cooling a residence or like building structure.

Still another object of this invention is to provide a system for minimizing the settling of a building foundation or floor slab.

A still further object of this invention is to provide a system for preventing the start of a roof fire by airborne sparks or embers.

Still another object of this invention is to provide an effective fire protection system for wood roof, which system can be installed at reasonable cost in either an existing or a new structure.

These objects are accomplished in a fire protection system which includes water dispensing means such as sprinkler heads mounted on the roof structure and above the exposed roof surface in a manner to effectively wet the entire roof surface either by direct spray or runoff. Feed pipe means feed water from a supply source, such as the water utility, to the dispensing means. A motorized gate valve connects the feed pipe to the supply source. A flame sensor circuit includes an electric current conductor disposed on the exposed roof surface and a signal device connected in an electrically energized circuit, with the signal device being triggered in response to a predetermined condition of the flame sensor circuit. A control circuit connects the signal device to the motorized valve, to effect the opening of the valve in response to the triggering of the signal device.

More particularly several of such flame sensor circuits may be provided each having an associated signal device, with all of the signal devices being connected by the control circuit to the motorized valve. Also more particularly a smoke sensor circuit includes a smoke sensitive device, disposed beneath the roof surface, and a second signal device, the signal device being triggered in response to detection of a selected smoke level. This second signal device is also connected by the control circuit to the motorized valve. Again several of said smoke sensor circuits may be provided.

Also more particularly the system may include an electric motor driven booster pump; and the control circuit may connect the several signal devices to the booster pump starting circuit to start the booster pump simultaneously with the opening of the motorized valve.

Still more particularly, the conductors of the flame sensor circuits are disposed in runs spaced at selected distances from each other, to be overrun quickly by a small roof fire.

The novel features and the advantages of the invention, as well as additional objects thereof, will be understood more fully from the following description when read in connection with the accompanying drawings.

DRAWINGS

DESCRIPTION OF THE PREFERRED EMBODIMENTS

Figure 1:
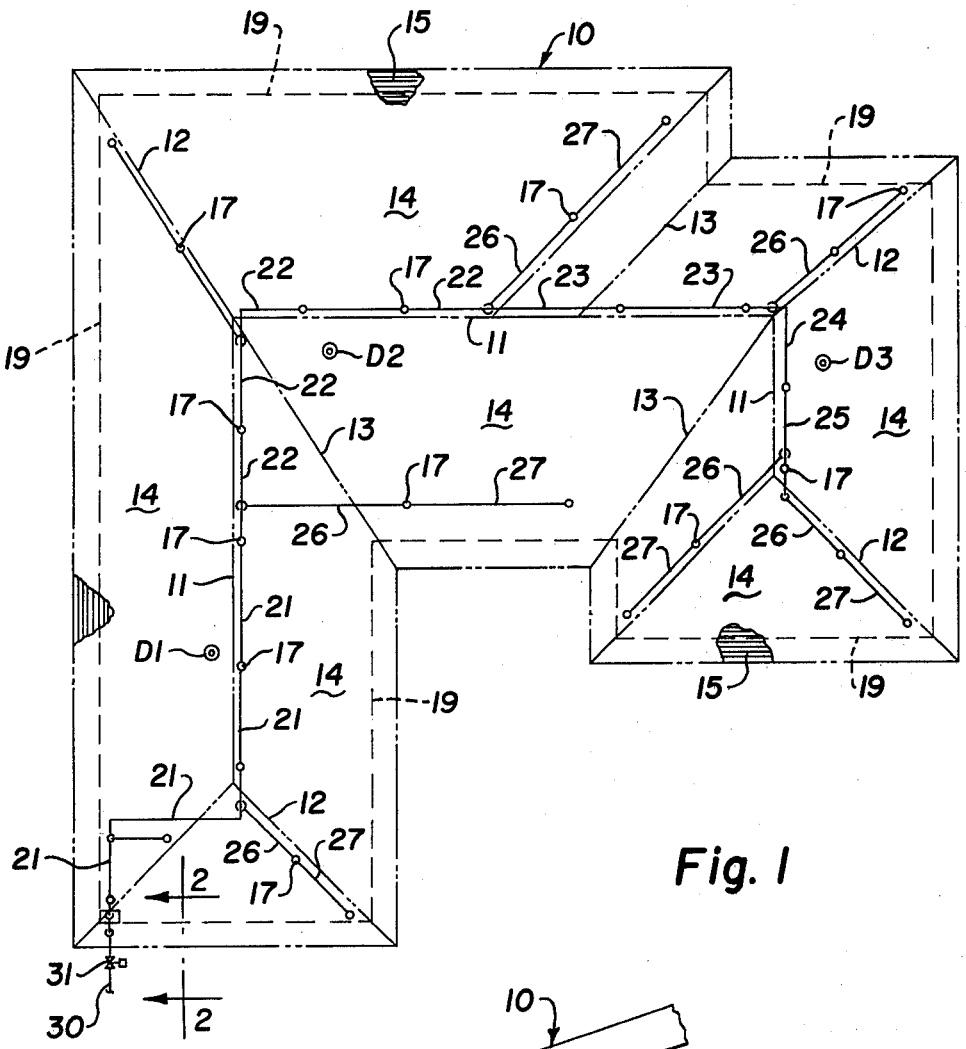
FIG. 1 is a diagrammatic plan view of a hipped roof of a residence, including water lines disposed in the attic.

FIG. 1 of the drawing is a plan view of a hipped roof 10 of a residence, the roof having sections 14 defined by the several ridges 11, hips 12 and valleys 13. The exposed roof surface consists of wood shingles which are nailed to the roof lathing nailed in turn to rafters 16. In the usual form of wood shingle roof, the shingles 15 are nailed in horizontal rows or courses, with the lower edges or lips of each course being aligned or linear.

A plurality of sprinkler heads 17 are disposed principally along the ridges and hips to provide 100% wetting coverage of the exposed roof surface, either by direct spray or by water flow or runoff. The heads are mounted on generally vertical risers 18 which extend upward through the roof surface, and are disposed selected distances above the surfaces. The ridge heads are mounted on vertical risers, with the heads being at least 4 inches above the ridge. The hip heads are mounted on risers perpendicular to the roof surface with the heads being a minimum of 3 inches above the surface. The sprinkler heads are preferably fabricated from brass, and are mounted on riser pipes preferably of copper to resist damage from the roof surface fire. Suitable boots are provided around the risers to prevent water ingress through the roof surface.

The feed pipe for supplying water to the several dispenser heads 17 traverses the attic of the structure and is suspended from the rafters adjacent to the underside of the roof surface by suitable hangers. The water feed piping includes a riser pipe 20, located adjacent a building wall 19 in the residence garage for example. In the illustrated system, this riser pipe may be 2½ inch pipe, for example; and the various sections of the feed pipe illustrated may be sized as indicated by the following sections. The pipe sections 21 may be 2½ inch pipe; the pipe sections 22 may be 2 inch pipe; the pipe 01006 sections 23 may be 1½ pipe; the pipe sections 24 may be 1¼ inch pipe; the pipe sections 25 may be 1 inch pipe; the pipe sections 26 may be ¾ inch pipe; and the pipe sections 27 may be ½ inch pipe. With sizing of this type, the pressure available at each dispenser will be approximately equal. The riser pipes 18 will also be ½ inch pipe for joining to ½ inch sprinkler heads.

Figure 2:
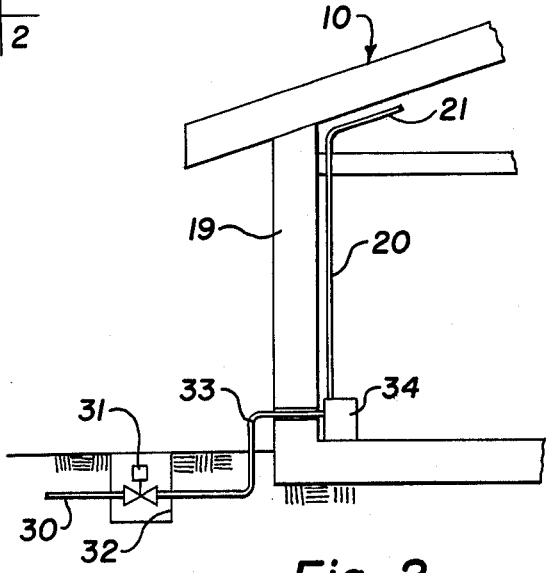
FIG. 2 is a diagrammatic fragmentary sectional view, taken along the line 2—2 of FIG. 1, showing the inlet plumbing and associated components.
Figure 3:
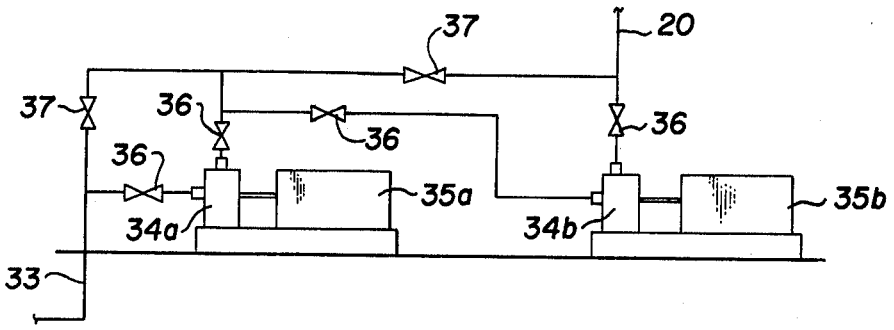
FIG. 3 is a schematic and diagrammatic illustration of a two-pump booster set up.
Figure 4:
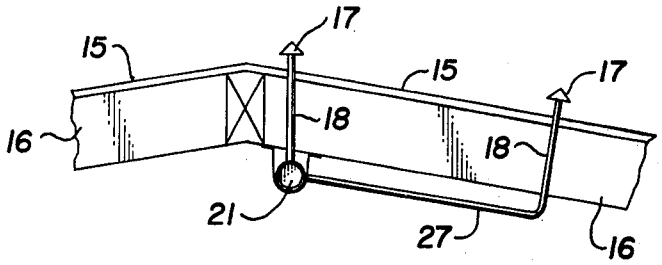
FIG. 4 is a diagrammatic fragmentary sectional view showing sprinkler heads and associated risers.

FIGS. 2 and 3 of the drawing illustrate the water supply control and booster system including an inlet pipe 30 extending from the meter, a motorized valve 31 in a ground box 32 adjacent to the residence structure, an entry pipe 33 passing through an opening in the building wall 19, and one or more centrifugal booster pumps 34 driven by associated electric motors 35. The motorized valve 31 may be a type which is normally closed by a spring motor and which is opened by an electrically energized motor. FIG. 3 illustrates a preferred arrangement of a two-pump booster system including pumps **34*a* and 34*b* driven by a respective coupled electric motors 35*a* and 35*b*. These pumps are connected with suitable gate valves so that they may be operated either in series or individually. In the illustrated arrangement with water supplied from the pipe 33, and with gate valves 36 all open, the pumps are connected in series to boost the water pressure supplied to the riser pipe 20. The gate valves 37 then are closed. Should one of the pumps fail during the operation, the water will nevertheless continue to flow through the inoperative pump being boosted by the remaining operative pump. To minimize pressure loss, the inoperative pump may be bypassed by selected manipulation of the gate valves 36 and 37**.

Figure 6:
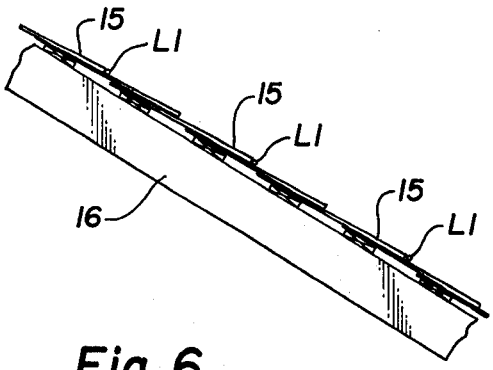
FIG. 6 is a fragmentary sectional view of a wood shingle roof, showing the shingle courses and the wire runs of a sensor loop.

The control system includes the electrically operated motorized valve 31 and the electric drive motors 35 of the pumps 34. In the schematic control circuit to be described, a single electric motor starter 35 is indicated. The automatic control circuit to be described, in connection with the schematic circuit of FIG. 5, responds to several types of sensors, in the event of a fire, to automatically open the motorized valve 31 and to start the one or two booster pumps 34 to effect very quickly the wetting of the entire roof surface and extinguish any small fire or fires which have been started by embers from a neighboring fire for example. One type of sensor is a flame sensor consisting of a loop of a continuous wire conductor connected in series with a power source and with a signal device. The wire loop is formed into runs possibly 6 inches or 12 inches from each other for example, so that a fire started on the roof surface will not have to spread very far before it overruns one of the runs of the wire loop and melts the wire to break the circuit. One form of conductor for the loop may be 28 or 30 gauge insulated copper wire which will melt in the heat of fire. FIG. 6 illustrates, by way of example, adjacent runs of wire L1 which are mounted adjacent to the lips of alternate wood shingle courses 15. Since this wire is fragile it would be protected to some extent by being disposed against the lips or edges of the shingle courses. This flame sensor responds to the heat of flame or embers directly contacting the conductor.

A preferred form of conductor for the above described conductor loop is a form of solder wire such as a 20 gauge wire having a 60-40 tin-lead composition. For ease of securing the wire to a roof surface, the wire is preferably provided with a pressure sensitive adhesive coating having good adhesion characteristics and which will retain its adhesive characteristics over a long period of time under adverse conditions.

The wire which is used for the described loop sensor must have a number of qualities or characteristics in order for it to function reliably in the described system, and also for it to function for a significant period of time. The wire must be able to withstand the elements such as sun, rain, wind, sleet and snow. The wire must be insulated since short circuits across runs would render ineffective portions of the loop beyond the short circuit. The wire must be tough, flexible and resilient and have adequate tensile strength. The wire must be able to withstand a number of forces, in addition to the elements. It must be resistant to the activities of animals that occasionally wander across building roofs. It must be able to withstand the weathering of wood shingles which in time results in curling, splitting and breaking of shingles. It must also be able to withstand the activities of humans who have occasion to walk on roofs for various purposes such as inspection, repair, and maintenance of other structures and equipment located on the roof.

From an economic standpoint, the wire for this loop sensor must have other characteristics. Considering that a 3000 square foot single story residence may require about 5000 feet of conductor loop, the wire employed must first be sufficiently economical of manufacture to encourage use of the system. Additionally the wire should have a capability of simple installation, and the ability to maintain itself in place once installed to obviate the need for frequent maintenance or repair.

The above mentioned 20 gauge tin-lead wire with a pressure sensitive adhesive coating is well suited for the intended purpose. The wire itself has most of the desired characteristics. The adhesive coating may be formulated to have the desired insulating properties; and a suitably formulated adhesive coating will have the desired adhesion characteristics. Wire having a pressure sensitive adhesive coating may be applied to the roof even in fairly high wind since the wire may be dispensed from spools immediately onto the roof surface and will adhere immediately. Apart from the wind conditions, this technique of laying the wire is rapid and correspondingly economical.

The second type of sensor might be referred to generally as a smoke sensor or detector. More particularly such smoke sensor may include an element which is responsive to a selected level or density of smoke, connected with a signal device such as the coil of a relay switch. In the system described these smoke sensors might be considered as backup sensors. It is known that when a fire is started at the exposed surface of a wood shingle roof, the fire quickly penetrates the wood shingles and burns on the underside of the roof surface spreading much more rapidly than on the exposed surface due to air currents through the opening at the fire. This, of course, creates smoke within the attic of the structure; and it is possible that a suitably located smoke sensor would respond to the smoke level before the fire at the exposed surface of the roof has progressed to a point where it would overrun one of the runs of a flame sensor. This would be particularly more likely if the runs of the wire loops were spaced further apart than 12 inches for example. Smoke sensors, then, would be placed at suitable locations in the attic as illustrated in FIG. 1.

Certain known smoke detectors are responsive to a selected heat level, in addition to a selected smoke level. These represent then a third type of sensor, namely a heat sensor. These heat sensors may respond to heat buildup due to a neighboring fire, to active the system to prevent the start of a new fire.

Figure 5:
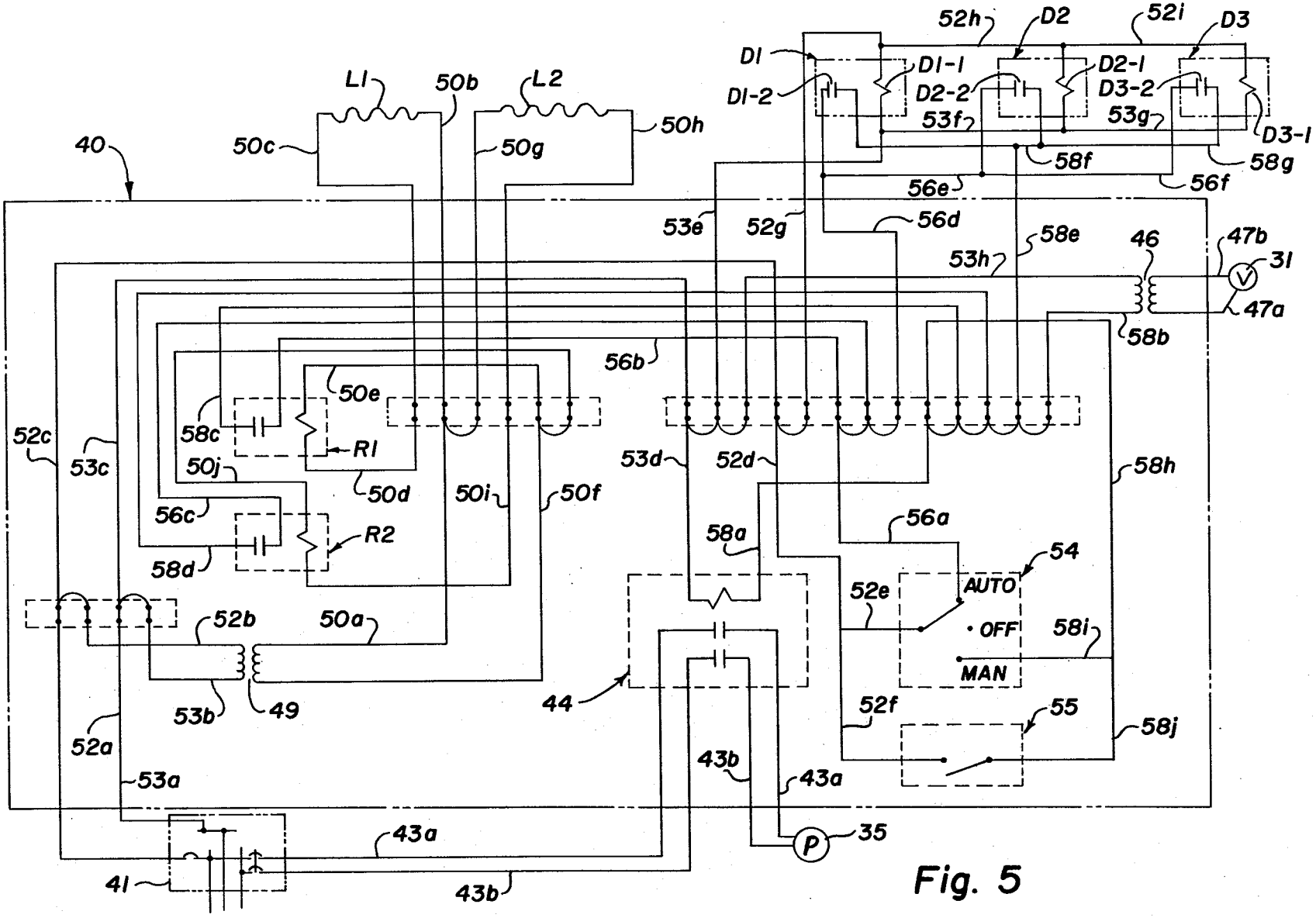
FIG. 5 is a schematic control circuit for the invention including sensor loops.

In the schematic circuit of FIG. 5, two flame sensor circuits are shown identified by the loops L1 and L2 which are connected in series respectively with the coils of relays R1 and R2, which relays are the signal devices. Three smoke sensors D1, D2, and D3 are shown in this schematic circuit and these are also indicated in FIG. 1. These smoke sensors include respective coils and switches, to be described, which are the signal devices of the respective smoke sensor circuits.

Referring now to the schematic circuit of FIG. 5, most of the control circuit would be contained within a control panel 40 mounted at a suitable location, such as in the garage near the booster pumps. The circuit includes a load center 41 which is the entry from the utility supply which is a three-wire 120/240 volt, single phase supply. The load center would include suitable circuit breakers.

The following description of the control circuit is concerned principally with automatic operation; however reference will be made also to manual operation and operation through a clock timer. The control circuit includes several sub-circuits which will be referred to as the supply circuit, the pump circuit, the valve circuit, the flame sensor circuit, the auto circuit, and the power circuit.

The pump circuit includes conductors 43*a* and 43*b* which supply 240 volt power to the pump motor 35 through the motor starter 44.

The valve circuit consists of the secondary of a transformer 46, having a 120 Volt primary and a 24 volt secondary for providing power through conductors 47*a* and 47*b* to the motorized valve 31.

The flame sensor circuits include a transformer 49 having a 120 volt primary and a 24 volt secondary for providing 24 volt power to the loops L1 and L2. The circuit for the loop L1 consists of conductors 50*a*, 50*b*, 50*c* and 50*d* connected to the coil of relay R1, with the ground side of the coil being connected to the transformer by conductors 50*e* and 50*f*. The circuit for the loop L2 consists of the conductors 50*a*, 50*g*, 50*h* and 50*i* connecting the loop to the coil of relay R2 with the ground side of the coil being connected to the transformer by conductors 50*j* and 50*f*. The relays R1 and R2 are of a type that the respective relay switches are closed when the respective coils are not energized, and are open when the coils are energized.

The supply circuit provides 120 volt power to certain of the sub-circuits; and for convenience the conductors of the supply circuit will be identified by the power side conductors 52 and the ground side conductors 53. The conductor 52*a* connected to the load center connects to the transformer 49 through conductor 52*b*, and connects through conductors 52*c*, 52*d* and 52*e* to the selector switch 54 to be described. Conductor 52*f* connects this power side to the clock timer 55. Through conductors 52*g*, 52*h* and 52*i*, this power side is connected to the coils D1-1, D2-1, and D3-1 of the respective smoke detectors D1, D2 and D3. Referring to the ground side, conductor 53*a* is connected to the load center and connects to the transformer 49 through conductor 53*b*. Through conductors 53*c* and 53*d* this circuit is connected to the motor starter 44. Through conductors 53*e*, 53*f* and 53*g* this circuit is connected to the coils of the respective smoke detectors D1, D2 and D3. Through conductor 53*h* this circuit is connected to the transformer 46 of the valve circuit.

Referring now to the smoke detectors, it will be seen that the coils of all the detectors are energized through this supply circuit. These coils along with respective switches D1-2, D2-2 and D3-2 function as relays in that when these detectors respond to the selected smoke density level the coils will act to close the respective switch to perform the function to be described.

Referring now to the selector switch 54, this switch has three positions: auto, off, manual. The switch is shown in the auto position for automatic operation; and the functions of the other switch positions will be described subsequently.

With the selector switch in the auto position, the power side of the supply circuit is connected to several components through the auto circuit conductors 56. Through conductors 56*a* and 56*b* one side of the switch of relay R1 is connected to the power side. Through conductors 56*a* and 56*c*, one side of the switch of relay R2 is connected to the power side. Through conductors 56*a*, 56*d*, 56*e* and 56*f* one side of the switches. D1-2 D2-2 and D3-2 of the respective smoke detectors are connected to the power side. These switches of the relays R1 and R2 and smoke detectors D1, D2 and D3 are normally open when the respective coils are energized as has been described.

The power circuit connects the other sides of the switches of the relays R1 and R2 and of the smoke detectors D1, D2 and D3 to the valve circuit and to the starter 44 of the motor circuit, so that when any one of these switches is closed, the motorized valve 31 will be opened and the pump motor or motors 35 will be started. Conductor 58*a* of the power circuit is connected to the motor starter 44 and conductor 58*b* is connected to the valve circuit. Conductor 58*c* of this power circuit is connected to the other side of the switch of relay R1 and conductor 58*d* is connected to the other side of the switch of relay R2. Through conductors 58*e*, 58*f*, and 58*g* the power circuit is connected to the switches D1-2, D2-2 and D3-2 of the respective smoke detectors.

The power circuit also provides the function of energizing the valve circuit and the motor starter circuit independently of the loop sensor circuits and the smoke detector sensor circuits. When the selector switch 54 is moved to the manual position, the power circuit is connected directly to the power side of the supply circuit through the conductors 58*h* and 58*i*. The selector switch then is a manual switch for turning the roof water sprinklers on at will. This is desirable in the event a roof fire is started and the automatic system fails. Also, in the event of a fire in a neighboring residence, it would be desirable to wet the roof immediately to prevent an ember from starting a fire in the first place. An additional purpose for the manual control may be to help reduce the air conditioner cooling load in the heat of the day. When a wood shingle roof is wetted, the shingles quickly absorb the moisture and will retain this for a length of time. If the water is turned on then for just a sufficient time to wet the shingles, then through evaporative cooling the roof surface will be cooled and stay cool for some period thereby reducing the buildup of heat through the roof surface into the attic of the residence. Additionally, the water running off the roof will cool the walls of the building particularly if the water is permitted to run down the walls; but water dripping from the roof eaves will also provide a cooling effect on the building walls.

When the selector switch 54 is moved to the off position, the system is inoperative since there is no power available at the switches of the several relays and smoke detectors to effect the energization of the valve circuit and the pump motor.

The use of the clock timer 55 is an alternative means for dispensing water onto the roof on a regular basis, such as for reducing the air conditioning load. The clock timer is connected directly to the power circuit through conductors 58*h* and 58*j*; and when the clock timer switch is closed the valve circuit and pump motor circuit are energized. By way of example, the clock timer might be set to activate the system for one-half hour each afternoon such as between 2:30 P.M. and 3:00 P.M.

OPERATION

The operation of the system represented by FIG. 5 is believed clear from the foregoing description, and will be only briefly summarized here. When the control circuit is energized at the load center 41 the pump motor circuit is armed in the sense that power is available at the motor starter 44 to start the motor or motors when the motor starter is energized. The flame sensor circuits L1 and L2 are energized, and the coils of the respective relays R1 and R2 are energized to open and hold open the respective switches of these relays. Similarly, the coils D1-1, D2-1 and D3-1 of the respective smoke detectors are energized to open and hold open the respective smoke detector switches. The ground side of the valve circuit is connected to the load center. The power circuit connects one side of the respective switches of the signal devices, that is the relays R1 and R2 and the smoke detectors D1, D2 and D3 to the valve circuit and the motor starter 44.

When the selector switch 54 is moved to the auto position, the auto circuit connects the other sides of these respective switches of the signal devices to the supply circuit. These five signal devices are then armed in the sense that, should the switch of any one of the signal devices close, the valve circuit and the motor starter will be energized to effect the dispensing of water onto the roof surface. For the signal devices R1 and R2, the respective switches will be closed should either of the sensor circuits be opened through the melting of the wire of the loops L1 or L2 to deenergize the respective coils. For the smoke detectors, the respective switches will be closed should any one of these detectors detect the preselected smoke level which would then effect the deenergization of the respective coil and the closing of the respective switch.

For manual or timed operation, through the selector switch 54 in the manual position or through the clock timer 55, the power circuit provides power directly to the valve circuit and the motor starter, bypassing the signal devices R1, R2, D1, D2 and D3.

EMBODIMENT OF FIG. 7

Figure 7:
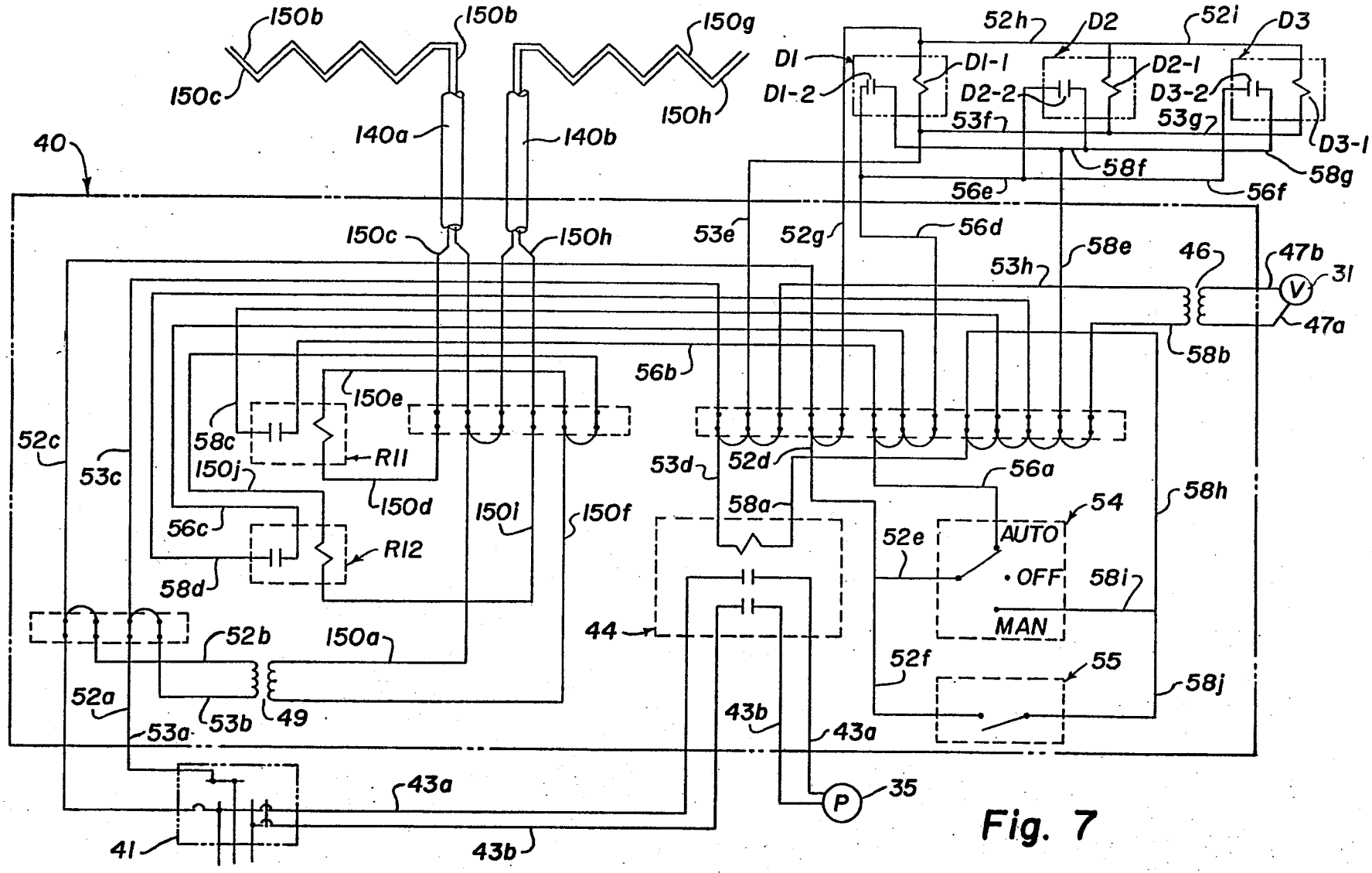
FIG. 7 is an alternative schematic control circuit for the invention, including sensor cables.

FIG. 7 is a schematic circuit which illustrates an alternative form of system according to the invention; this alternative form including a different type of conductor loop flame sensor to be laid along the courses of wood shingles, and associated flame sensor circuits. These flame sensors will be referred to as cable sensors C1 and C2, and will perform the functions of the above described loop sensors L1 and L2 but in a different manner.

The cable sensors C1 and C2 each consist of a length of two-wire cable, with only one end of the cable being connected at the control panel 40. The cable, then, may be laid on the roof surface in any desired arrangement, preferably in runs generally parallel to each other and being spaced from each other from 6 to 12 inches for example in a manner similar to the wires of the loop sensors. At the distal end of each cable sensor, the cable wires are not connected so that the cable represents an open circuit sensor rather than closed loop sensors as are the sensors L1 and L2.

The two wires of a cable sensor are insulated from each other and are disposed in side-by-side or perhaps twisted relation to form a cable where the wires are nearly contiguous, separated only by an insulating layer. The functional criteria of these cable sensors is that the cable will respond to the heat of flame, to effect the melting or breakdown of the separating insulation and the consequent joining of the cable wire to close the circuit in which the cables are connected. The one end of a cable sensor is connected in series with the coil of a relay signal device.

With this type of flame sensor the relays R11 and R12 of the flame sensor circuits are of a different type, namely that the respective switches of the relays will be normally open when the respective coils are not energized, and that these respective relay switches will close when the coils are energized.

Referring now to the schematic circuit of FIG. 7 in detail, this circuit is identical to that previously described and illustrated in FIG. 5, except that the previously described loop sensors and associated circuits are now replaced by the cable sensors and associated circuits. The cable sensor circuits include the transformer 49 having a 120 volt primary and a 24 volt secondary, for providing 24 volt power to the cable sensor circuits C1 and C2. The cable sensor C1 consists of a cable 140*a* having side-by-side conductors 150*b* and 150*c*. The circuit for the cable sensor C1 consists of the conductor 150*a* connecting the transformer 49 to the cable conductor 150*b*. Conductor 150*d* connects the cable conductors 150*c* to one side of the coil of relay R11; and the other side of this coil is connected to the transformer by conductors 150*e* and 150*f*. When the transformer 49 is energized, this circuit is open since the distal ends of the cable conductors 150*b* and 150*c* are not connected. Similarly, the cable sensor C2 consists of the cable 140*b* having side-by-side conductors 150*g* and 150*h*. The cable conductor 150*g* is connected to the transformer by the conductor 150*a*. The cable conductor 150*h* is connected to one side of the coil of relay R12 by the conductor 150*i*. The other side of this coil is connected to the transformer by the conductors 150*j* and 150*f*. This circuit is also open, when the transformer is energized, since the distal ends of the conductors 150*g* and 150*h* are not connected.

OPERATION OF FIG. 7 SYSTEM

The operation of this alternative system is generally similar to that of the system illustrated in FIG. 5. As with the previous system, when the system is turned on for automatic operation, the system is armed in the sense that, should any relay switch close for any of the relays R11, R12 or smoke sensors D1, D2 or D3, the system will effect the dispensing of water from the sprinkler heads.

The cable sensor circuits are normally open circuits; and the switches of the relays R11 and R12 are maintained open for the open circuit condition of these cable sensor circuits. Should either circuit be closed, resulting from the melting or other breakdown of the cable insulation by flame generating heat, the conductor pairs will be joined to close the respective cable sensor circuit thereby energizing the relay coil to close the respective contact switch.

ALTERNATIVE WATER DISPENSING APPARATUS

A water dispensing system including sprinkler heads, such as the sprinkler head 17 described with respect to FIG. 1, presents some disadvantages. One disadvantage is that in a high wind there may be certain areas of the roof surface which are not reached and wetted by the water spray from the sprinkler heads. This of course reduces the overall reliability of the overall system. Another disadvantage is water loss. While water loss would not be of concern in the event of the primary use of the system to prevent fire damage, this may be of concern for other uses of the system such as to improve the cooling of the structure.

Figure 8:
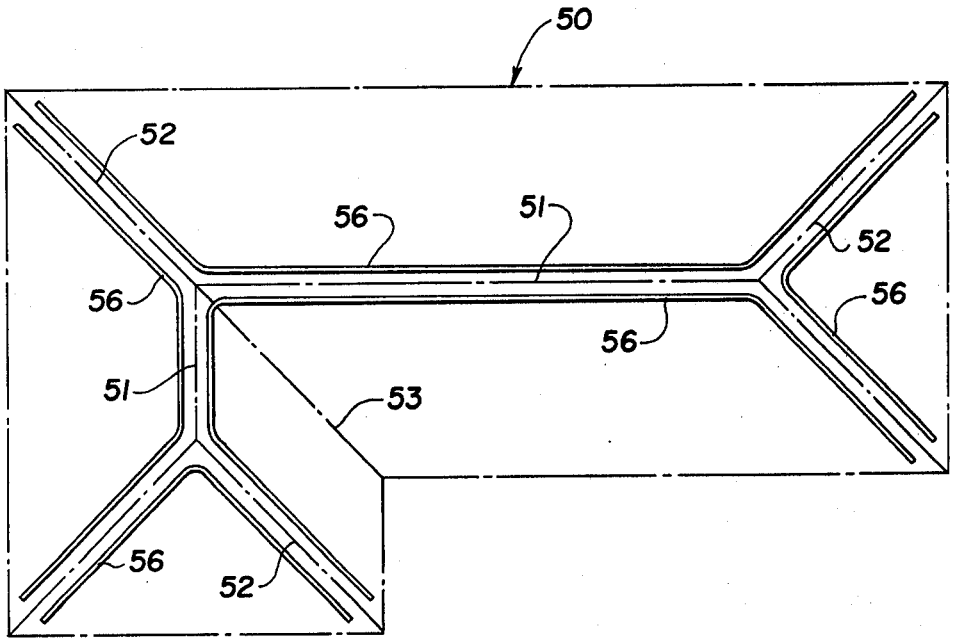
FIG. 8 is a diagrammatic plan view of a hipped roof, including a porous hose water dispenser.
Figure 9:
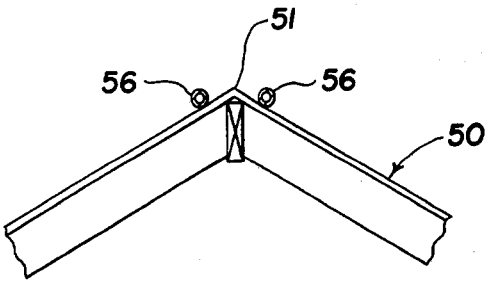
FIG. 9 is a fragmentary sectional view taken along the line 9—9 of FIG. 8.

FIGS. 8 and 9 of the drawing illustrate another form of water dispensing apparatus which is very effective for accomplishing the purposes of this invention. This alternative form of apparatus includes the use of a flexible porous hose disposed adjacent to, and on both sides of, the ridges and hips of a roof structure. FIG. 8 is a plan view of a hipped roof 50 of a residence having roof sections defined by the several ridges 51, hips 52 and valleys 53. The roof may have the same conventional structure described with respect to FIG. 1. As seen in the drawings, in order to have full wetting coverage of the roof sections, lengths of the porous hose 56 are placed on both sides of each ridge 51 and each hip 52 close to the apexes of those ridges and hips. The porous hose may be secured to the roof in any desired manner, such as by straps of plastic or other suitable material nailed to the roof. The water supply system for the porous hose may include a system of feed pipes within the attic structure of the building, including risers extending through the roof and having nipples to which the hose is suitably secured. Alternatively, the supply pipe system could be mounted under the eaves at the exterior of the building structure.

A suitable form of flexible porous hose for this purpose is a product marketed under the name Leaky Pipe by Trek Services, Inc. of Dallas, Tex. Forms of this product are the subject of U.S. Pat. Nos. 4,003,408 issued Jan. 18, 1977 and 4,168,799 issued Sept. 25, 1979.

A suitable form of flexible porous hose is composed primarily of granulated rubber particles and a polyethylene binder mix fabricated to provide a porous side wall having labyrinthine passageways. Characteristics of this flexible porous hose which make it particularly suitable in the fire protection system of the invention include the fact that up to 2000 feet of the hose may be supplied with the usual water pressure available at the residence. A typical residence might require about 400 feet of the hose and this length of hose may be supplied very adequately with a water pressure of only two psi. Another desirable characteristic of this flexible hose is that the flow of water will be uniform throughout its length. The applicant has discovered that a roof protection system of the type described is effective if the entire surface of the roof can be wetted within five minutes from the time the fire is detected by the sensor system. With the runs of the loop sensor spaced sufficiently close, little time will be consumed for the fire to overrun and activate the sensor. Using a porous hose of the type described, the applicant has discovered that for a roof surface where the distance from ridge to eave is 16 feet, the water will travel from ridge to eave within two minutes, and only about three to five minutes is required to achieve total saturation or wetting of the roof surface. Where a building roof has substantially longer distances between the ridges and eaves, it would be desirable to install intermediate lengths of porous hose between the ridges and eaves.

What has been described is a unique and effective system and method for preventing significant damage to a residence or other structure having wood shingles, from a fire originating at the roof surface particularly from a flying ember. A very important aspect of the system is the response time between the start of a fire and the extinguishing of the fire. This response time has two components: (a) the time required to detect the fire once it has started and (b) the time required to extinguish the fire once it has been detected.

A particular feature of the invention is the type of sensor employed by means of which the response time for detecting the fire can be controlled and minimized. The use of the conductor loop sensors enables the placing of the runs of the loops in the desired spaced relation and thereby fix the maximum detection time in relation to how fast a fire spreads on a wood shingle roof for example. A feature of the invention is the use of the described conductor loops and particular forms of conductors which enable a practical system, a system which may be installed at reasonable cost, and a system designed to withstand the various elements and forces acting on it in its exposed condition on the roof surface.

A particular feature and advantage of the invention is the use of wire coated with a pressure sensitive adhesive which facilitates the installation of the conductor loop on the roof surface, even under adverse wind conditions, and at the same time provides a lasting and secure installation for maximum reliability.

The second aspect of the response time involves the wetting or saturation of the entire roof surface within a specified time limit. A feature and advantage of the invention is the utilization of a flexible porous hose for this purpose which has the principal advantages of dispensing an adequate amount of water onto the roof surface with the water pressures normally available at residences and also to dispense the water uniformly since the flow rate from the hose is uniform throughout its length. Also, a flow rate from the porous hose can be provided which is adequate to saturate fully a large roof surface when the hose is placed along the ridges and hips.

A feature and advantage of the system is that it is completely automatic, and will respond to a small fire ignited at the roof surface and extinguish that fire before it can spread to do any significant damage. Another particular feature of the invention is that it can be activated manually when desired and operated for a selected time to wet the roof surface. This is particularly advantageous in the event of a fire in a neighboring residence or building, and would serve to effectively prevent the start of a fire at the residence having the system.

Another advantage of manual operation of the system is to enable use of the system to wet the roof and possibly the walls of the building to reduce the air conditioning load during the heat of the day. An ancillary advantage of this is that where the water runs off the roof to the ground around the structure, the ground adjacent to the foundation may be wetted at selected intervals to prevent excessive drying of the soil and resulting settling of the building foundation or floor slab.

A further advantage of the system is that it is quite simple in structure and can be installed in a building for a very reasonable cost. An advantage of the preferred form of system utilizing sprinkler heads is that a minimum of unsightly structure appears on the roof surface; and this is particularly desirable in the case of a residence structure. An ancillary advantage is that the water feed system is within the attic, not exposed to the elements and not subject to deterioration for that reason.

Another feature and advantage of the system is the use of the flame sensor circuits as an effective means for detecting a small roof surface fire before the fire can spread significantly, and the use of smoke sensors in the attic as a supplemental and backup system to detect the smoke created when the fire burns to the underside of the roof surface. It has been observed that fire spreads much more rapidly on the underside of a wood shingle roof surface than on the exposed top side. With the use of the smoke detector backup system, the wire runs of the flame sensor circuits may be spaced further apart, resulting in some economy of installation, and yet provide effective protection as described.

While the preferred embodiments of the invention have been illustrated and described, it will be understood by those skilled in the art that changes and modifications may be resorted to without departing from the spirit and scope of the invention.

While, in the preferred embodiments, the wiring of the flame sensors are on the upper exposed surface of the roof, which would be the most economical installation, it may be desirable in some instances to secure the wire of these sensors of the under surface of the roof. Similarly, while in the preferred embodiment the pipes feeding the water dispensers are supported in the attic area under the roof surface, it may be desirable with certain roof structures such as cathedral ceilings to mount these water feed pipes on the exposed roof surface.

What is claimed is:

1. In a fire protection system for a building roof, said system including: water dispensing means mounted on said building and disposed for wetting the exterior roof surface; supply means for feeding water from a water supply source to said dispensing means; and motorized valve means connecting said supply means to said supply source; the improvement comprising:

a sensor circuit comprising a loop of an electric current conductor disposed on said exterior roof surface and a signal device connected in an electrically energized circuit; said signal device being triggered in response to a selected open or closed condition of said sensor circuit; and said signal device being connected to said motorized valve means to effect the opening of said valve in response to the triggering of said signal device 2. In a fire protection system as set forth in claim 1, the improvement comprising the conductor of said loop being disposed on said roof surface to form adjacent runs spaced apart a selected relatively close distance from each other, to enable rapid overrunning of a run by a fire spreading on said roof surface 3. In a fire protection system as set forth in claim 2, the improvement comprising said roof surface being formed from successive courses of wood shingles; said conductor runs being disposed contiguous to the exposed edges of said courses.

4. In a fire protection system as set forth in claim 1, the improvement comprising said loop comprising a cable consisting of a pair of contiguous conductors insulated from each other with a meltable insulation material; the conductors of said cable being connected at one end in series with said signal device in an open circuit; said signal device being triggered in response to the closing of said sensor circuit by the electrical joining of said contiguous conductors, resulting from the melting of said insulation material.

5. In a fire protection system as set forth in claim 1, the improvement comprising said loop comprising a continuous, meltable, single wire conductor connected in series with said signal device in a closed circuit; said signal device being triggered in response to the opening of said sensor circuit resulting from the severing of said single wire conductor of said loop.

6. In a fire protection system as set forth in claim 5, the improvement comprising said single wire conductor being coated with a pressure sensitive adhesive.

7. In a fire protection system as set forth in claim 6, the improvement comprising said pressure sensitive adhesive coating having electrically insulating properties.

8. In a fire protection system as set forth in claim 5, the improvement comprising said single wire conductor comprising a 20 gauge wire strand having a tin-lead composition.

9. In a fire protection system as set forth in claim 8, the improvement comprising said 20 gauge wire strand having a 60-40 tin lead composition.

10. In a fire protection system as set forth in claim 1, the improvement comprising said dispensing means comprising lengths of a porous conduit disposed on said exterior roof surface parallel to and adjacent to the ridges of said roof surface.

11. In a fire protection system as set forth in claim 10, the improvement comprising said porous conduit comprising a hollow walled conduit fabricated from a composition of granulated elastomer particles and a polyethylene binder mix, and having a plurality of labyrinthine through-the-wall seepage passageways.

12. In a fire protection system as set forth in claim 1, the improvement comprising:

said supply means including pipe runs suspended under the roof surface and including generally vertical risers extending through the roof surface;

said dispensing means comprising sprinkler heads mounted on the upper ends of said risers.

13. In a fire protection system as set forth in claim 1 the improvement comprising:

said signal device including a function switch and an operator coil;

a control circuit including a supply circuit, a power circuit, an auto circuit, and a selector switch; said supply circuit supplying energy to one side of said motorized valve, and energizing said signal device coil; said power circuit connecting one side of said function switch to said motorized valve;

said selector switch having an off position and an auto position; and said auto circuit connecting the other side of said function switch to said supply circuit, through said selector switch auto position, to arm said signal device whereby, when said function switch closes, said motorized valve is energized to effect the dispensing of water.

14. In a fire protection system as set forth in claim 13, the improvement comprising:

said selector switch including a manual position; said selector switch in said manual position connecting said power circuit to said supply circuit, to energize directly said motorized valve to effect the opening of said valve.

15. In a fire protection system as set forth in claim 1, the improvement comprising:

a second sensor circuit disposed beneath said roof surface comprising a heat sensitive device and a second signal device; said heat sensitive device being responsive to a selected heat level, and said signal device being triggered in response to detection of said selected heat level; and said second signal device being connected to said motorized valve, to effect the opening of said valve in response to the triggering of said second signal device.

16. In a fire protection system as set forth in claim 1, the improvement comprising:

a second sensor circuit disposed beneath said roof surface comprising a smoke sensitive device and a second signal device; said smoke sensitive device being responsive to a selected smoke level, and said signal device being triggered in response to detection of said selected smoke level;

and said second signal device being connected to said motorized valve, to effect the opening of said valve in response to the triggering of said second signal device.

17. A method for protecting a building roof against fire including the steps providing water dispensing means for wetting the exterior roof surface;

controlling the supplying of water to said water dispensing means by an electrically operated device;

providing a sensor comprising a loop of an electric current conductor and said electrically operated device connected in an electrically energized circuit;

mounting said conductor of said loop on said roof surface in adjacent runs spaced to be overrun quickly by a fire spreading on said roof surface;

and operating said electrically operated device in response to a change from an open or a closed condition of said electrically energized circuit, effected when said loop is exposed to the heat of fire, to control said supplying of water.

18. A method as set forth in claim 17, including the step spacing said adjacent runs about eight to twelve inches from each other.

19. A method as set forth in claim 17, wherein the building has a wood shingle roof arranged in courses, including the step disposing said runs contiguous to the exposed edges of said shingle courses.

20. A method as set forth in claim 17, including the steps providing said loop as cable of a contiguous pair of conductors insulated from each other with a meltable insulation material, with said insulation material being meltable in the heat of fire;

and connecting said conductor pair, at one end of said cable, in series with said electrically operated device in an open circuit, whereby said electrically operated device is operated in response to the closing of said electrically energized circuit when said conductor pair becomes electrically joined resulting from the melting of the insulation material.

21. A method as set forth in claim 17, including the steps providing said loop as a continuous single wire conductor meltable in the heat of fire;

and connecting said single wire conductor in series with said electrically operated device in a closed circuit, whereby said electrically operated device is operated in response to the opening of said electrically energized circuit when said single wire conductor is ruptured by melting.

22. A method as set forth in claim 21, including the step providing said continuous single wire as a single 20 gauge strand fabricated from a 60-40 tin-lead composition.

23. A method as set forth in claim 17, including the steps adhering said loop on said roof surface by means of a pressure sensitive adhesive applied to said loop.

24. A method as set forth in claim 17, including the step providing, as said water dispensing means, a porous hollow walled conduit fabricated from a composition of granulated elastomer particles and a polyethylene binder mix, and having a plurality of labyrinthine through-the-wall seepage passageways; and mounting said conduit on the roof surface adjacent to the ridges thereof.

* * * * *